US005774100A

United States Patent [19]

Aoki et al.

[11] Patent Number: 5,774,100

[45] Date of Patent: Jun. 30, 1998

[54] ARRAY SUBSTRATE OF LIQUID CRYSTAL DISPLAY DEVICE

[75] Inventors: Yoshiro Aoki; Youichi Masuda, both of Yokohama, Japan

[73] Assignee: Kabushiki Kaisha Tobshiba, Kawasaki, Japan

[21] Appl. No.: 721,620

[22] Filed: Sep. 26, 1996

[30] Foreign Application Priority Data

Sep. 26, 1995 [JP] Japan ..... 7-248069

[51] Int. Cl.[6] ..... G09G 3/36

[52] U.S. Cl. ..... 345/87; 345/904

[58] Field of Search ..... 345/94, 87, 904; 324/192, 42

[56] References Cited

FOREIGN PATENT DOCUMENTS 63-052121 3/1988 Japan .
63-116190 5/1988 Japan .

*Primary Examiner*—Richard A. Hjerpe
*Assistant Examiner*—Ricardo Osorio

[57] ABSTRACT

An array substrate of an LCD device includes a glass substrate, an n×m number of pixel electrodes arrayed in a matrix form on the glass substrate, an n-number of scanning lines formed along rows of the pixel electrodes on the glass substrate, an m-number of signal lines formed along columns of the pixel electrodes on the glass substrate, switching elements formed on the glass substrate and located adjacent to intersections of the scanning lines and signal lines, each switching element supplying a video signal from the signal line to the pixel electrode in response to a scanning signal supplied from the scanning line, and a test supporting circuit for sensing potentials of the scanning lines. The test supporting circuit includes a test section comprising an n-number of testing thin film transistors whose gates are connected to the scanning lines and a test wiring section connected to source-drain paths of the testing thin film transistors thereby to detect the operation states of the testing thin film transistors corresponding to the gate potentials thereof. The test wiring section includes first and second test pads between which the source-drain paths of the testing thin film transistors are connected in parallel, a third test pad to which a test voltage is applied with the first test pad used as a reference, and a resistive element connected between the second and third test pads, the test voltage being divided according to a resistance ratio between the resistive element and the testing thin film transistors.

6 Claims, 9 Drawing Sheets

ARRAY SUBSTRATE OF LIQUID CRYSTAL DISPLAY DEVICE

BACKGROUND OF THE INVENTION

1. Field of the Invention

The present invention relates generally to an array substrate of a liquid crystal display (LCD) device and more particularly to an array substrate in which a plurality of pixel electrodes are integrated along with driving circuits for driving the pixel electrodes.

2. Description of the Related Art

Recently, liquid crystal display (LCD) technology has been applied to video equipments such as video projectors and viewfinders. For example, when three LCD devices (or LCD panels) are provided to display a color image, these LCD devices operate to selectively transmit red light, green light and blue light obtained by splitting white light into spectral components by means of a dichroic mirror, etc. The light transmittance distribution of each LCD device is controlled by a liquid crystal drive circuit connected to the LCD device via a plurality of connection pads. The light transmitted from these LCD devices is focused by a lens to form a color image at a display position.

A conventional video equipment is expensive and occupies a large space since it generally has a large optical system formed of the lens, the dichroic mirror, etc. In order to make the optical system small, it is necessary to reduce the size of the LCD device while maintaining the resolution. To meet the demand, the pixel density of the LCD device is increased to a maximum, and the areas and intervals of connection pads are decreased accordingly. Since the decrease in the areas and the intervals of the connection pads is limited to prevent reliable connection from being impaired, a scheme of incorporating the LCD drive circuit into the LCD device has been proposed to dispense with the connection pads.

The structure of the LCD device of the aforementioned scheme will now be briefly described. The LCD device generally comprises an array substrate on which a plurality of pixel electrodes are arrayed in a matrix form, a counter-substrate on which a counter-electrode is formed to face the matrix array of the pixel electrodes, an a liquid crystal layer held between the array substrate and the counter-substrate. The array substrate comprises a plurality of scanning lines formed along rows of the pixel electrodes, a plurality of signal lines formed along columns of the pixel electrodes, and a plurality of thin film transistors (TFTs) constituting switching elements formed adjacent to intersections of the associated scanning and signal lines. Each TFT comprises a gate connected to one scanning line, a source connected to one pixel electrode, and a drain connected to one signal line. The LCD drive circuit comprises a scanning line driver and a signal line driver both formed on the array substrate in an area outside the matrix array of the pixel electrodes. The scanning lines are connected to the scanning line driver, and the signal lines are connected to the signal line driver. The scanning line driver sequentially supplies a scanning signal to the scanning lines, and the signal line driver supplies video signals to the signal lines each time the TFTs of each row are simultaneously turned on by the scanning signal. Thereby, each pixel electrode is set at a pixel potential corresponding to the video signal supplied via the associated TFT. The light transmittance distribution of the LCD device is determined by a distribution of voltages applied to the liquid crystal layer between the pixel electrodes and the counter-electrode set at a reference potential.

In general, the LCD device is manufactured through a step of producing the array substrate, a step of producing the counter electrode, and a step of combining the array substrate and counter-electrode with the liquid crystal layer interposed therebetween. In the step of producing the array substrate, the LCD drive circuit is integrated along with a display circuit including the pixel electrodes, scanning lines, signal lines and TFTs. The array substrate is produced such that the plural scanning lines and signal lines are directly connected to the LCD drive circuit. In this case, the display circuit and LCD drive circuit cannot be inspected without operating the display circuit through the LCD drive circuit. In other words, the display circuit and the LCD drive circuit are not operable independently. This makes it difficult to detect all the defects present in wiring lines such as signal lines and scanning lines. Even if the defect is detected to be present, it is difficult to specify where the defect is located in the wiring lines. Accordingly, a test operation needs to be performed in order to confirm that the produced LCD device (or panel) is defectless. If the operation of the LCD device is not normal, it is discarded as defective one. Even if the defect is apparently present in the array substrate, the array substrate cannot properly be separated from the counter-electrode and liquid crystal layer and therefore, the counter-electrode and liquid crystal layer are discarded along with the array substrate.

For example, Jpn. Pat. Appln. KOKAI Publication No. 63-52121 and JAPAN DISPLAY '92.561 "S14-2 3.7-in. HDTV Poly-Si TFT-LCD Light Valve with Fully Integrated Peripheral Drivers" teach techniques of testing the array substrate by using a plurality of testing transistors formed at end portions of wiring lines, such as scanning lines and signal lines.

Jpn. Pat. Appln. KOKAI Publication No. 63-52121 shows a circuit structure wherein wiring lines are respectively connected to the source-drain paths of testing transistors, and the gates of each testing transistor is connected to the source-drain path of the adjacent testing transistor. When defects are present in all even-numbered wiring lines, it may be observed that the defects are present not only in the even-numbered wiring lines but also in the odd-numbered wiring lines. As a result, the array substrate cannot be tested correctly.

JAPAN DISPLAY '92.561 "S14-2 3.7-in. HDTV Poly-Si TFT-LCD Light Valve with Fully Integrated Peripheral Drivers" shows a circuit structure wherein wiring lines are respectively connected to the source-drain paths of testing transistors which are divided into a plurality of groups, and the gates of the testing transistors of each group are commonly connected to each other. With this structure, the array substrate cannot be tested correctly if a defect is present in the testing transistor itself. Specifically, if the gate insulation film is destroyed in one of the testing transistors, the gate of this testing transistor is electrically short-circuited to the associated wiring line. Consequently, it may be observed that defects are present in all the testing transistors which belong to the same group as the defective testing transistor and in all the wiring lines connected to these transistors.

In the techniques of these documents, the yield and reliability of array substrates tend to be lowered due to the provision of testing transistors. Further, the circuit structures of these techniques are not capable of testing the display circuit formed of the scanning lines, signal lines and TFTs, without operating the LCD drive circuit. In particular, in Jpn. Pat. Appln. KOKAI Publication No. 63-52121, the wiring structure on the array substrate becomes complex due to the wiring lines which are formed for switching the testing transistors in units of a group thereof.

SUMMARY OF THE INVENTION

An object of the present invention is to provide an array substrate for a liquid crystal display device, which can be tested to exactly specify the location of a defect without requiring a highly complicated construction.

The object can be achieved by an array substrate for a liquid crystal display device, which comprises: an insulating substrate; a plurality of pixel electrodes arrayed in a matrix form on the insulating substrate; a set of first pixel wiring lines formed along rows of the pixel electrodes on the insulating substrate; a set of second pixel wiring lines formed along columns of the pixel electrodes on the insulating substrate; a plurality of switching elements, formed on the insulating substrate at positions adjacent to intersections of the first and second pixel wiring lines, each for supplying a video signal from a corresponding one of the second pixel wiring lines to a corresponding one of the pixel electrodes in response to a scanning signal from a corresponding one of the first pixel wiring lines; and a test supporting circuit for sensing potentials of at least one set of the first and second pixel wiring lines. The the test supporting circuit includes a first test section having a plurality of testing thin film transistors whose gates are respectively connected to the pixel wiring lines of one set, and a test wiring section connected to source-drain paths of the testing thin film transistors and used to detect operation states of the testing thin film transistors corresponding to gate potentials thereof. The test wiring section includes first and second test pads between which the source-drain paths of the testing thin film transistors are connected in parallel, a third test pad to which a test voltage is applied with the first test pad used as a reference, and a resistive element connected between the second and third test pads, the test voltage being divided according to a resistance ratio between the resistive element and the testing thin film transistors.

In the array substrate of the present invention, the gates of the thin film transistors (TFTs) are connected to pixel wiring lines of one set, and the test wiring section is connected to the source-drain paths of the testing TFTs and used to detect operation states of the testing TFTs corresponding to gate potentials thereof. At the time of a defect inspection of the array substrate, a voltage of, e.g. a scanning signal or a video signal is applied to the switching elements via each pixel wiring line. If a defect such as disconnection, short-circuit, or element destruction is present in one pixel wiring line or the switching element connected to the pixel wiring line, the potential of the pixel wiring line varies depending on the kind of defect. Therefore, the testing TFT serves to sense the potential of the pixel wiring line. Specifically, the testing TFT is controlled by the potential of the scanning line to have a electrical conductivity or resistance reflecting the kind of defect. Thus, the information about the defect can be obtained by supplying a current through the test wiring section to the testing TFTs and measuring a voltage drop across the testing TFTs. Further, it is possible to specify where the defect is located by sequentially obtaining defect information with respect to all the pixel wiring lines of one set.

The test wiring section is electrically insulated from each pixel wiring line by means of the gate insulating film of a corresponding testing TFT. This structure solves the prior art problem that one pixel wiring line connected to the gate of a testing TFT is short-circuited to another pixel wiring line when the gate electrode and source-drain path of the testing TFT are electrically in contact with each other due to a defect in, e.g., the gate insulating film formed therebetween.

If the source-drain paths of the testing TFTs are connected in parallel by using a common line, the wiring structure of the array substrate is prevented from being complicated to attain a reliable defect inspection. In addition, when the switching elements are thin film transistors, these switching elements can be formed along with the testing TFTs through the common manufacturing process. Therefore, an individual process is not required for forming the testing TFTs.

According to the present invention, defects in the pixel wiring lines or switching elements can be exactly detected without greatly changing the circuit components or requiring complicated wiring structure. Since the defects can be detected substantially independently for the respective pixel wiring lines or switching elements, the locations of the defects can easily be specified. As for a defective testing TFT included in the test supporting circuit, it can be removed to prevent yield of array substrates from being decreased.

A defect inspection can be performed by using the test supporting circuit after the array substrate has been produced or main circuit components of the array substrate have been formed. The defect inspection can be performed irrespective of the step of producing the counter-substrate and the step of combining the array substrate and counter-substrate with the liquid crystal layer interposed. As a matter of course, the defect inspection does not need to be performed after manufacture of the liquid crystal display device is completed. Therefore, the defectless counter-substrate or liquid crystal layer can be prevented from being discarded due to the defect in the array substrate. This enhances the yield of liquid crystal display devices.

The earlier detection of a defect in the electric circuit in the manufacturing process of the liquid crystal display device contributes not only to enhancing the yield and reducing the manufacturing cost, but also to maintaining the reliability of the liquid crystal display device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

A liquid crystal display (LCD) device according to a first embodiment of the present invention will now be described with reference to the accompanying drawings.

Figure 1:
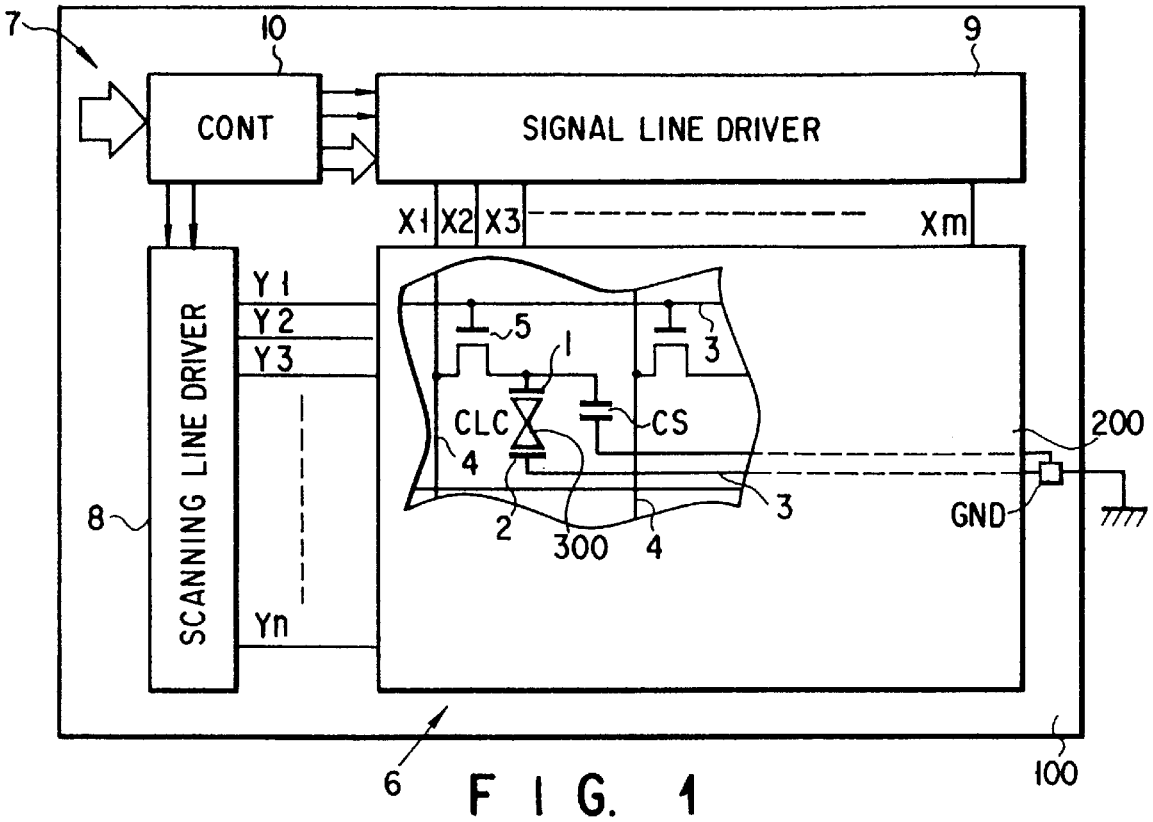
FIG. 1 schematically shows a planar structure of a liquid crystal display (LCD) device according to a first embodiment of the present invention.
Figure 2:
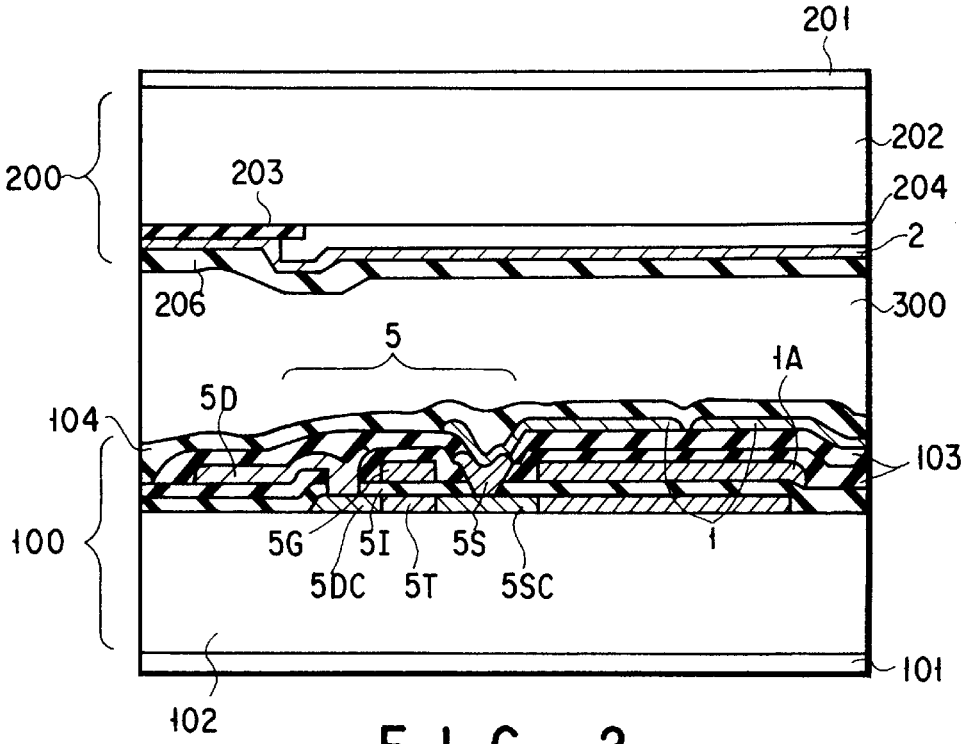
FIG. 2 schematically shows a cross-sectional structure of the LCD device shown in FIG. 1.

FIG. 1 schematically shows a planar structure of the LCD device, and FIG. 2 schematically shows a cross-sectional structure of the LCD device. The LCD device comprises an array substrate 100 on which m×n pixel electrodes 1 are arrayed in a matrix form, a counter-substrate 200 on which a single counter-electrode 2 is provided so as to face the matrix array of the pixel electrodes 1, a liquid crystal layer 300 held between the array substrate 100 and the counter-substrate 200, and polarizing plates 101 and 201 affixed to the array substrate 100 and counter-substrate 200 on the sides opposite to the liquid crystal layer 300.

The array substrate 100 includes a transparent glass substrate 102 on which the m×n pixel electrodes 1 are provided. The array substrate 100 further includes an n-number of scanning lines (Y1 to Yn) formed along rows of the pixel electrodes 1, an m-number of signal lines 4 (X1 to Xm) formed along columns of the pixel electrodes 1, and m×n thin film transistors (TFTS) each formed at a position adjacent to intersections of a corresponding one of the scanning lines 3 and a corresponding one of the signal lines 4 and each serving as a switching element. Each of the TFT 5 has a gate electrode 5G connected to the corresponding scanning line 3, a source electrode 5S connected to the corresponding pixel electrode 1, and a drain electrode 5D connected to the corresponding signal line 4. The gate electrode 5G is an electrode which is formed as part of the scanning line 3. The TFT 5 further has a semiconductor layer 5T of polysilicon formed on the glass substrate 102 and a gate insulating film 5I formed on the semiconductor layer 5T and the gate electrode 5G. The source and drain electrodes 5S and 5D are electrodes which are formed in contact with source and drain regions 5SC and 5DC formed in the semiconductor layer 5T on the both sides of the gate electrode 5G. The drain electrode 5D is formed as part of the signal line 4. The pixel electrode 1 is formed in contact with the source electrode 5S. The array substrate 100 further includes storage capacitance lines 1A formed over the glass substrate 102 substantially in parallel to the scanning lines 3. Part of the storage capacitance line 1A overlaps and capacitively coupled to the pixel electrode 1 via an insulating protection film 103 to form a storage capacitance CS, and is electrically connected to the counter-electrode 2 of the counter-substrate 200. The pixel electrodes 1, scanning lines 3, signal lines 4 and TFTs 5 constitute the display circuit 6 on the array substrate 100. Besides, the array substrate 100 has a liquid crystal drive circuit 7 which is formed on an area outside the matrix array of the pixel electrodes 1 to drive the display circuit 6. The LCD drive circuit 7 includes a scanning line driver 8 connected to the n-number of scanning lines 3, a signal line driver 9 connected to the m-number of signal lines 4, and a liquid crystal controller 10 for controlling the scanning line driver 8 and signal line driver 9. The scanning line driver 8 and signal line driver 9 are constituted by conventional shift-registers, etc. The scanning line driver 8 sequentially supplies a scanning signal to the n-number of scanning lines 3. The signal line driver 8 supplies video signals to the m-number of signal lines 4 while the TFTs 5 of one row are simultaneously turned on. Thereby, each pixel electrode 1 is set at a pixel potential according to the video signal supplied via the corresponding TFT 5. The display circuit 6 and LCD drive circuit 7 are covered with the protection film 103. The protection film 103 and pixel electrodes 1 are covered with an orientation film 104.

The counter-substrate 200 includes a light-shield layer 203 which is formed on a transparent glass substrate 202 to shield unnecessary light, and color stripe portions 204 which are formed on the glass substrate 202 and surrounded by the light-shield layer 203 to filter light passing through the pixel electrodes 1 provided on the array substrate 100. The counter-electrode 2 is formed to cover the light-shield layer 203 and the color stripe portions 204, and an orientation film 206 is formed to cover the counter-electrode 2.

The liquid crystal layer 300 consists of a liquid crystal composition sealed in a gap between the orientation film 104 of the array substrate 100 and the orientation film 206 of the counter-substrate 200.

Figure 3:
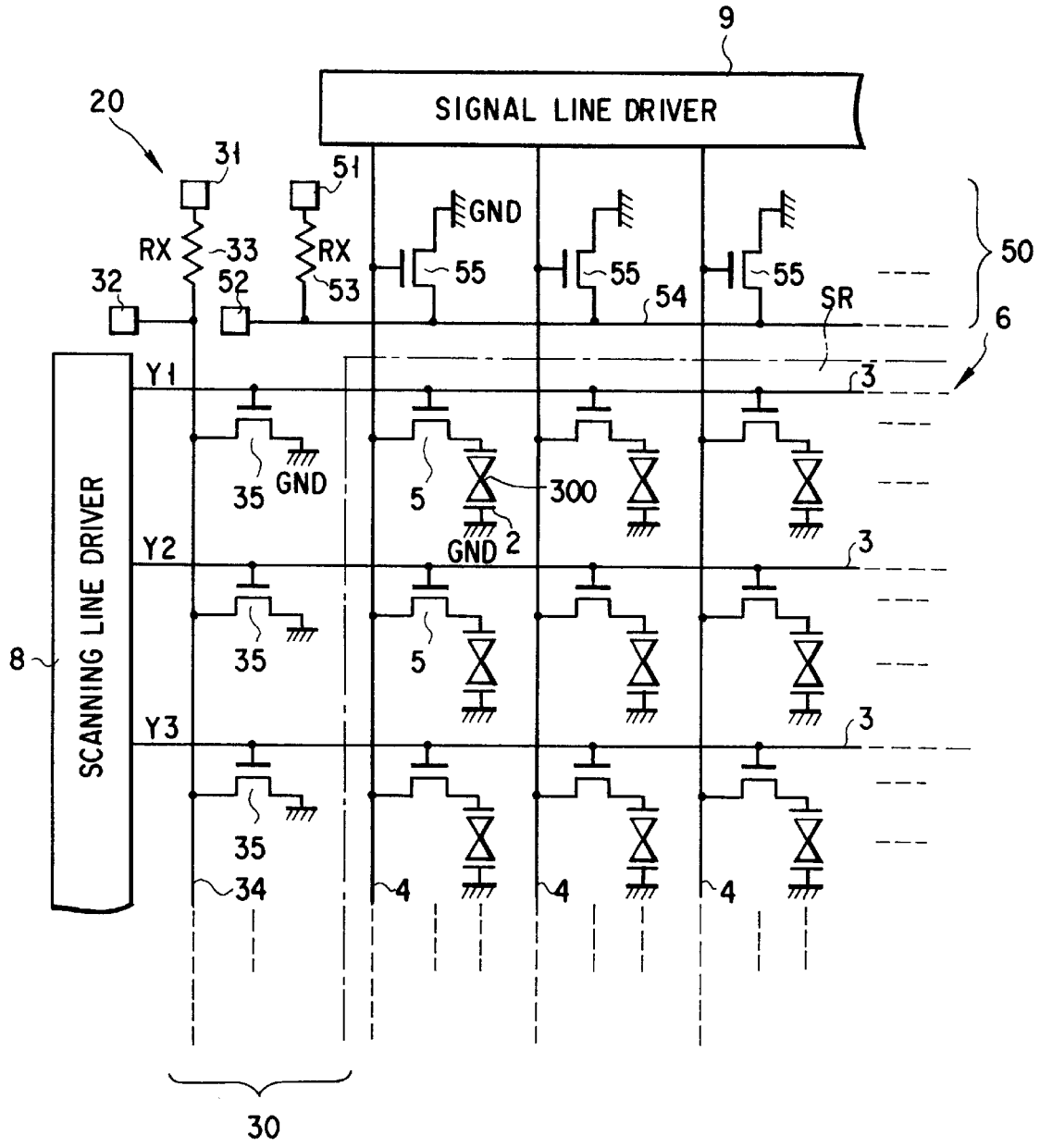
FIG. 3 shows in detail the circuit formed on the array substrate shown in FIG. 1.

The counter-electrode 2 is capacitively coupled to each pixel electrode 1, thereby constituting liquid crystal capacitances CLC, and is connected to a ground pad GND set at a reference potential of, e.g. 0 V. The light transmittance distribution of the LCD device is determined by the distribution of voltages applied to the liquid crystal layer 300 between the counter-electrode 2 and pixel electrodes 1. In FIGS. 1 and 3, the counter-electrode 2 and liquid crystal layer 300 are shown in an equivalent circuit form.

FIG. 3 shows in detail the circuit formed on the array substrate 100. The matrix array of pixel electrodes 1 is formed in a display area SR corresponding to the area of the counter-substrate 200 where the counter-electrode 2 is formed. The array substrate 100 has a test supporting circuit 20 formed in a region outside the display area SR. The test supporting circuit 20 includes a scanning line test section 30 which is used to detect defects in the n-number of scanning lines 3 (Y1–Yn) and in the TFTs 5 connected to the scanning lines 3, and a signal line test section 50 which is used to detect defects in the m-number of signal lines 4 (X1–Xm) and in the TFTs 5 connected to the signal lines 4.

The scanning line test section 30 has a test potential pad 31, a monitor pad 32, a resistive element 33 connected between the pads 31 and 32, a test wiring line 34 disposed in parallel to the signal lines 4 and connected to the monitor pad 32, and an n-number of testing thin film transistors (testing TFTS) 35 each having a source-drain path connected between the test wiring line 34 and the ground pad GND and having a gate connected to a corresponding one of the scanning lines 3. At the time of the defect inspection, a test voltage Vh is applied between the test potential pad 31 and ground pad GND. (The test voltage Vh is determined according to the threshold voltages of the testing TFTs 35 such that each of the testing TFTs 35 is turned on upon supply of the scanning signal.)

The signal line test section 50 includes a test potential pad 51, a monitor pad 52, a resistive element 53 connected between the pads 51 and 52, a test wiring line 54 disposed in parallel to the scanning lines 3 and connected to the monitor pad 52, and an m-number of testing thin film transistors (testing TFTs) 55 each having a source-drain path connected between the test wiring line 54 and the ground pad GND and having a gate connected to a corresponding one of the signal lines 4. At the time of the defect inspection, a test voltage Vh is applied between the test potential pad 51 and ground pad GND. (The test voltage Vh is determined according to the threshold voltages of the testing TFTs 55 such that each of the testing TFTs 55 is turned on upon supply of the video signal of a specified level.)

In general, the LCD device as described above is manufactured through a step of producing the array substrate 100, a step of forming the counter electrode 200, and a step of combining the array substrate 100 and counter-electrode 200 with the liquid crystal layer 300 interposed therebetween. In the step of producing the array substrate 100, the testing TFTs 35 and 55 are formed along with the TFTs 5 through a common manufacturing process. Thus, the TFTs 5, 35 and 55 are formed to have the same structure with the same material. However, the TFT 5 has device dimensions capable of obtaining a property suitable for the switching operation, the testing TFTs 35 have device dimensions capable of obtaining properties suitable for the sensing operations of sensing potentials of the scanning lines 3, and the testing TFTs 55 have device dimensions capable of obtaining properties suitable for the sensing operation of sensing potentials of the signal lines 4. These device dimensions can be defined, for example, by a photomask pattern for use in the patterning performed to form the TFTs 5, 35 and 55. Individual processes are not required to form these TFTs 5, 35, and 55 even if the device dimensions differ from each other.

A description will now be given of a defect inspection to be carried out after the array substrate 100 of the above-described LCD device has been produced or main circuit components of the array substrate 100 have been produced.

The defect inspection with use of the scanning line test section 30 will first be described. In the defect inspection, the scanning line driver 8 is controlled to select an n-number of scanning lines 3 one by one and supply a scanning signal to the selected scanning line 3. The potential of each scanning line 3 varies depending on the kinds of defects, e.g. short-circuit and disconnection of the scanning line 3, destruction of the TFT 5 connected to the scanning line 3, and a malfunction of the scanning line driver 8 connected to the scanning line 3. The potentials of the n-number of scanning lines 3 are sensed by the n-number of testing TFTs 35, respectively. The conductivity or resistance of the TFT 35 depends on the sensed potential. In brief, each testing TFT 35 is rendered conductive by the potential of the corresponding scanning line 3 to which the scanning signal is supplied, and is kept non-conductive by the potential of the corresponding scanning line 3 to which no scanning signal is supplied. The test voltage Vh is divided by a voltage divider formed of the parallel testing TFTs 35 and the resistive element 33, and supplied to the monitor pad 33 as a monitor output voltage corresponding to a voltage drop across the parallel testing TFTs 35. The monitor output voltage is measured for each of the scanning lines 3 which are sequentially selected by the scanning line driver 8. The location and kind of each defect is specified based on the result of measurement. (During the defect inspection with use of the scanning line test section 30, the signal line driver 9 is controlled to perform an operation in which the same video signals or no video signals are supplied to all m-number of signal lines 4 in order to eliminate influence caused due to variations in test conditions.)

When the scanning signal is supplied from the scanning line driver 8 to the selected scanning line 3, the monitor output voltage is at voltage level Von. The voltage level Von is represented by $$Von = \frac{Vh}{\frac{Rx\{Roff + Ron(n-1)\}}{Ron \cdot Roff} + 1},$$

wherein Ron is the ON resistance of the testing TFT 35, Roff is the OFF resistance of the testing TFT 35, and Rx is the resistance of the resistive element 33. When Ron is sufficiently lower than Roff, the voltage level Von can be approximated by equation $$Von = Vh/(Rx/Ron+1).$$

When the scanning signal is not supplied from the scanning driver 8 to the selected scanning line 3, the monitor voltage is at voltage level Voff. The voltage level Voff is expressed by equation Voff=Vh/(n·Rx/Roff+1).

Accordingly, if the scanning line driver 8 operates normally, the monitor output voltage is substantially at level Von, irrespective of the selected scanning line 3. The scanning line driver 8 is regarded as defective if the monitor output voltage is substantially at level Voff when a specific scanning line 3 is selected by the scanning line driver 8. Since the source-drain path of the TFT 5 is electrically separated from a current flowing route from the test potential pad 31 to the ground pad GND via the source-drain path of the testing TFT 35, the monitor output voltage does not depend on the on/off state of the TFT 5.

For example, when short-circuit has occurred between k-number of scanning lines 3, such as first and second scanning line Y1 and Y2, have been short-circuited, the scanning signal is supplied from the scanning line driver 8 to the first scanning line Y1, and then from the first scanning line Y1 to the second scanning line Y2. Thus, the two testing TFTs 35 connected to the first and second scanning lines Y1 and Y2 are rendered conductive, concurrently. When the scanning signal is supplied to the k-number of scanning lines 3, as mentioned above, the monitor output voltage is at voltage level Vonk. The voltage level Vonk is expressed by $$Vonk = \frac{Vh}{\frac{Rx\{k \cdot Roff + Ron(n-k)\}}{Ron \cdot Roff} + 1},$$

wherein k is positive integer greater than 1 and less than n. When Ron is sufficiently lower than Roff, the voltage level Vonk can be approximated by equation $$Vonk = Vh/(k \cdot Rx/Ron+1).$$

The short-circuit is thus detected on the basis of the fact that the monitor output voltage is set at voltage level Vonk when each of the k-number of scanning lines 3 has been selected by the scanning line driver 8.

(For example, when disconnection has occurred in a single scanning line 3, such as a first scanning line Y1, a parasitic capacitance of the scanning line Y1 decreases. In this case, the potential of the first scanning line Y1 varies more quickly than usual, after the scanning signal has been supplied from the scanning driver 8. Accordingly, the disconnection of the line Y1 is detected on the basis of the fact that the monitor output voltage has transited to voltage level Von in a shorter time period than usual. The parasitic capacitance of the scanning line Y1 also varies due to the destruction of the TFT 5 connected to the scanning line 3. Thus, if the transition time of the monitor output voltage has varied, it is determined that the scanning line 3 has been disconnected or the TFT 5 has been destroyed.)

The defect inspection with use of the signal line test section 50 will now be described. In the defect inspection, the signal line driver 9 is controlled to select an m-number of signal lines 4 one by one and supply the video signal of a specified level, which turns on the testing TFT 55, to the selected signal line 4. The potential of each signal line 4 varies depending on the kinds of defects, e.g. short-circuit and disconnection of the signal line 4, destruction of the TFT 5 connected to the signal line 4, and a malfunction of the signal line driver 9 connected to the signal line 4. The potentials of the m-number of signal lines 4 are sensed by the m-number of testing TFTs 55, respectively. The conductivity or resistance of the TFT 55 depends on the sensed potential. In brief, each testing TFT 55 is rendered conductive by the potential of the corresponding signal line 4 to which the video signal is supplied, and is kept non-conductive by the potential of the corresponding signal line 4 to which no video signal is supplied. The test voltage Vh is divided by a voltage divider formed of the parallel testing TFTs 55 and the resistive element 53, and supplied to the monitor pad 52 as a monitor output voltage corresponding to a voltage drop across the parallel testing TFTs 55. The monitor output voltage is measured for each of the signal lines 4 selected by the signal line driver 9. The location and kind of each defect is specified based on the result of measurement. Since the locations and kinds of the defects are specified in the same manner as in the case of the scanning line test section 30, repetitive explanations are omitted. (During the defect inspection with use of the signal line test section 50, the scanning line driver 8 is controlled to perform an operation in which a scanning signal or no scanning signal is supplied to one scanning line 3.)

In the array substrate of the LCD device according to the first embodiment, defects such as a malfunction of the scanning line driver 8, short-circuit and disconnection of the scanning line 3 connected to the scanning line driver 8 and destruction of the TFT 5 connected to the scanning line 3 can be detected by measuring the monitor output voltage supplied to the monitor pad 32. In addition, defects such as a malfunction of the signal line driver 9, short-circuit and disconnection of the signal line 3 connected to the signal line driver 9, and destruction of the TFT 5 connected to the signal line 4 can be detected by measuring the monitor output voltage supplied to the monitor pad 52.

Each scanning line 3 is connected to the gate of the corresponding testing TFT 35, and the gate is electrically insulated by a gate insulating film from the source-drain path of the testing TFT 35 connected to the test wiring line 34. If a defect of incomplete gate insulation is present in the testing TFT 35, this may cause the scanning signal to be supplied into the test wiring line 34 from the scanning line 3 connected to the gate of the testing TFT 35. On the other hand, each signal line 4 is connected to the gate of the corresponding testing TFT 55, and the gate is electrically insulated by a gate insulating film from the source-drain path of the testing TFT 55 connected to the test wiring line 54. If a defect of incomplete gate insulation is present in the testing TFT 55, this may cause the video signal to be supplied into the test wiring line from the signal line 4 connected to the gate of the testing TFT 55.

Such a problem, however, can be solved by separating the gate of the defective testing TFT 35 or 55 from the scanning line 3 or signal line 4 by means of, e.g. a laser repair device.

In this case, the defect inspection for the array substrate 100 is made substantially impossible. However, supposing that the other components have no defect, the array substrate can be used in manufacturing the LCD device. If it is confirmed that the display performance of the manufactured LCD device is satisfactory, the LCD device can be authorized as a defectless product.

In addition, no individual manufacturing process is required to form the testing TFTs 35 and 55, since they can be formed through the same manufacturing process as the TFTs 5. Furthermore, dimensional differences between the TFTs 35 and 55 and the TFTs 5 are defined by a photomask pattern for use in the patterning performed to form the TFTs 5, 35, and 55. Therefore, the TFTs 35 and 55 can be formed along with the TFTs 5 on the array substrate 100 without additionally requiring any complicated process.

In the present embodiment, a voltage drop across the parallel circuit of testing TFTs 35 (or 55) is measured at the monitor pad 32 (or 52) as a monitor output voltage. However, a parameter other than the voltage can be measured. For example, the wiring structure of the array substrate 100 may be modified so as to measure the value of a current flowing through the parallel circuit of testing TFTs 35 (or 55) under application of test voltage Vh and detect the defect from the measured value of the current. Alternatively, the resistance of the parallel circuit of testing TFTs 35 (or 55) can be measured by using the ground pad GND and monitor pad 32. This measurement does not require the test voltage Vh to be applied between the test potential pad 31 (or 51) and the ground pad GND.

A liquid crystal display (LCD) device according to a second embodiment of the invention will now be described.

Figure 4:
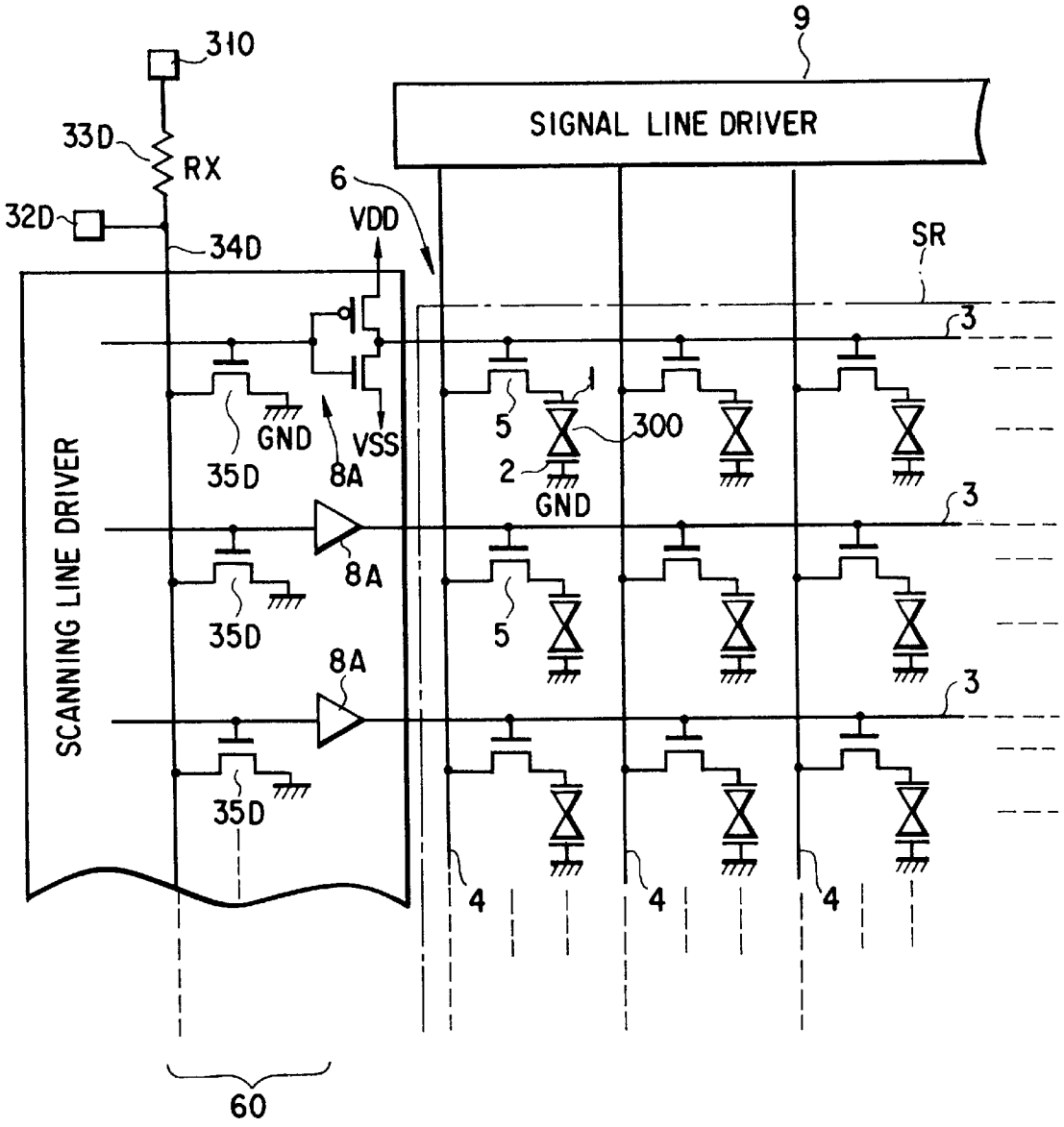
FIG. 4 shows a circuit formed on an array substrate of an LCD device according to a second embodiment of the invention.

FIG. 4 shows a circuit formed on an array substrate of this LCD device. The LCD device of the second embodiment is similar to that of the first embodiment described with reference to FIGS. 1 to 3. In FIG. 4, similar components are denoted by the same reference numerals as those shown in FIGS. 1 to 3, and, therefore, repetitive explanations thereof are omitted.

In the array substrate of the LCD device, a driver test section 60 is provided within the scanning line driver 8 in order to more surely detect a malfunction of the scanning line driver 8. For the purpose of easier understanding of the defect inspection with use of the driver test section 60, the scanning line test section 30 and signal line test section 50 shown in FIG. 3 are not provided in this embodiment. The scanning line driver 8 normally includes an n-number of output buffers 8A for sequentially supplying to the n-number of scanning lines 3 (Y1–Yn) a scanning signal whose voltage amplitude is suitable for turning on the TFTs 5. Each output buffer 8A is formed of conventionally known CMOS transistors and converts the scanning signal to have an amplitude of a voltage applied between power supply terminals VDD and VSS shown in FIG. 4.

The driver test section 60 includes a test potential pad 31D, a monitor pad 32D, a resistive element 33D connected between the pads 31D and 32D, a test wiring line 34D disposed in parallel to the signal lines 4 and connected to the monitor pad 32D, and an n-number of testing TFTs 35D each having a source-drain path connected between the test wiring line 34D and the ground pad GND and a gate connected to an input terminal of the corresponding buffer 8A. At the time of the defect inspection, a test voltage Vh is applied between the test potential pad 31D and ground pad GND. (The test voltage Vh is determined according to the threshold voltages of the testing TFTs 35D such that each of the testing TFTs 35D is turned on upon supply of the scanning signal input to the corresponding output buffer 8A.) The driver test section 60 has substantially the same structure as the scanning line test section 30 shown in FIG. 3, except that the testing TFTs 35D sense the potentials of the input terminals of the output buffers 8A, respectively.

According to the second embodiment of the invention, the n-number of scanning lines 3 (Y1–Yn) selectively driven by the scanning line driver 8 are electrically separated from the testing TFTs 35D by the output buffers 8A of the scanning line driver 8. The potential of each scanning line 3 varies, in the same manner as in the first embodiment, due to a defect occurring in the TFTs 5 connected to this scanning line 3. For example, when the resistance between the gate and source of the TFT 5 has considerably decreased due to the defective gate insulating film, the potential of the scanning line 3 falls from the level of the scanning signal supplied to the scanning line 3. Therefore, if the potential of each scanning line 3 is sensed in the manner of the first embodiment in order to test the scanning line driver 8, there is a possibility that the scanning line driver 8 is determined to be defective despite the fact that the scanning signal is supplied to the scanning line 3. In the second embodiment, however, the scanning line driver 8 is tested with a use of the testing TFTs 35D for sensing the potentials of the input terminals of the output buffers 8A, which are electrically separated from the scanning lines 3. Specifically, the potentials of the input terminals of the output buffers 8A are not influenced by a defect occurring mainly within the display circuit 6, e.g. disconnection or short-circuit of the scanning line 3 or incomplete gate insulation of the TFT 5. Thus, the malfunction of the scanning line driver 8 can be exactly distinguished from the defect of the display circuit 6 in the same test sequence as that of the first embodiment.

In the meantime, in order to surely detect a malfunction of the signal line driver 9, the signal line driver 9 may include a driver test section formed to sense the potentials of the input terminals of output buffers provided therein.

An LCD device according to a third embodiment of the invention will now be described.

Figure 5:
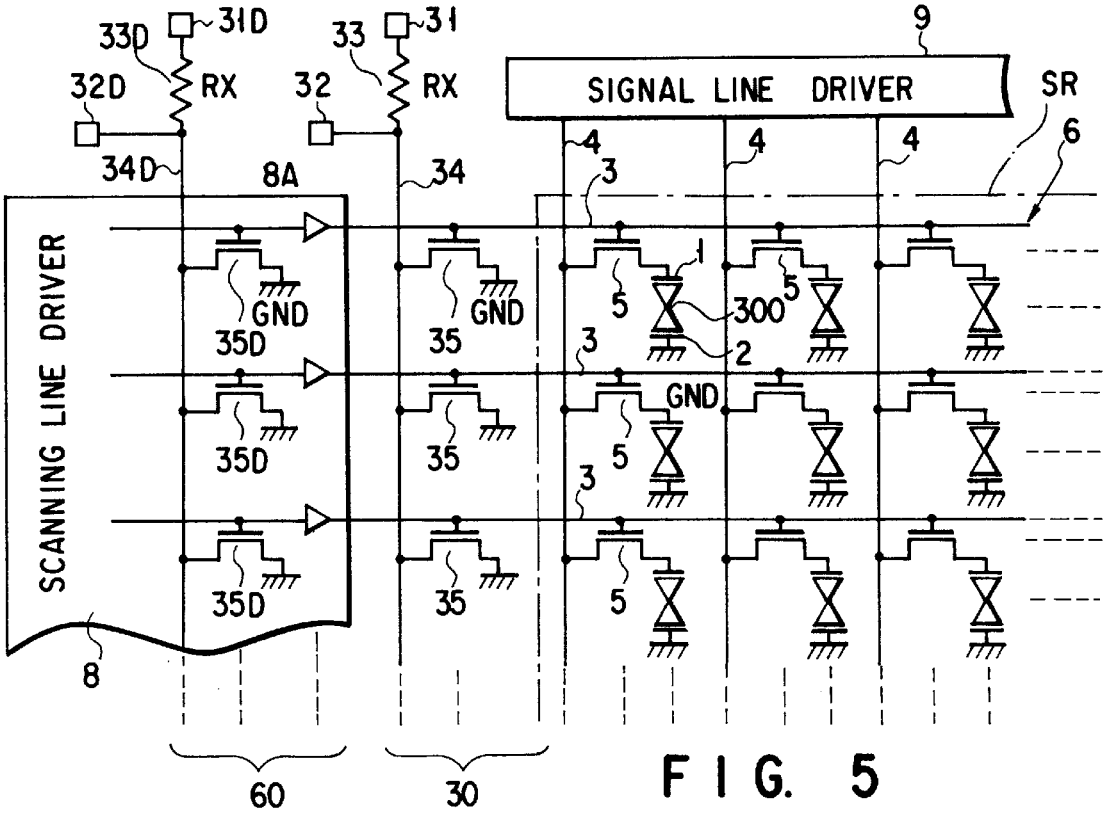
FIG. 5 shows a circuit formed on an array substrate of an LCD device according to a third embodiment of the invention.

FIG. 5 shows a circuit formed on an array substrate of the LCD device. The LCD device of the third embodiment is similar to the devices of the first and second embodiments described with reference to FIGS. 1 to 4. In FIG. 5, similar components are denoted by the same reference numerals as those shown in FIGS. 1 to 3, and, therefore, repetitive explanations thereof are omitted.

In the array substrate of the LCD device, the scanning line test section 30 shown in FIG. 3 and the driver test section 60 shown in FIG. 4 are provided. In this embodiment, for the purpose of easier understanding of the defect inspection with a use of the combination of the scanning line test section 30 and the driver test section 60, the signal line test section 50 shown in FIG. 3 is not provided.

The scanning line test section 30 includes a test potential pad 31, a monitor pad 32, a resistive element 33 connected between the pads 31 and 32, a test wiring line 34 disposed in parallel to the signal lines 4 and connected to the monitor pad 32, and an n-number of testing thin film transistors (testing TFTS) 35 each having a source-drain path connected between the test wiring line 34 and ground pad GND and having a gate connected to an output terminal of the corresponding output buffer 8A. At the time of the defect inspection, a test voltage Vh is applied between the test potential pad 31 and ground pad GND.

The driver test section 60 includes a test potential pad 31D, a monitor pad 32D, a resistive element 33D connected between the pads 31D and 32D, a test wiring line 34D disposed in parallel to the signal lines 4 and connected to the monitor pad 32D, and an n-number of testing TFTs 35D each having a source-drain path connected between the test wiring line 34D and the ground pad GND and a gate connected to an input terminal of the corresponding output buffer 8A. At the time of the defect inspection, a test voltage Vh is applied between the test potential pad 31D and ground pad GND.

With the above structure, the potential of the monitor pad 32D is first monitored to test the scanning line driver 8 and then the potential of the monitor pad 32 is monitored to detect a defect occurring within the display circuit 6.

According to the third embodiment of the invention, the n-number of scanning lines 3 (Y1–Yn) selectively driven by the scanning line driver 8 are electrically separated from the testing TFTs 35D by the output buffers 8A of the scanning line driver 8. The potential of each scanning line 3 varies, in the same manner as in the second embodiment, due to a defect occurring in the TFTs 5 connected to this scanning line 3. As has been described in connection the second embodiment, for example, when the resistance between the gate and source of the TFT 5 has considerably decreased due to the defective gate insulating film, the potential of the scanning line 3 falls from the level of the scanning signal supplied to the scanning line 3. Therefore, if the potential of the scanning line 3 is sensed by the testing TFT 35 in order to test the scanning line driver 8, there is a possibility that the scanning line driver 8 is determined to be defective despite the fact that the scanning signal is supplied to the scanning line 3. Thus, the testing TFTs 35D are used to sense the potentials of the input terminals of the output buffers 8A separated electrically from the scanning lines 3. Specifically, the potentials of the input terminals of the output buffers 8A are not influenced by a defect occurring mainly within the display circuit 6, e.g. disconnection or short-circuit of the scanning line 3 or incomplete gate insulation of the TFT 5. Accordingly, the malfunction of the scanning line driver 8 can be exactly distinguished from the defect of the display circuit 6 in the same test sequence as that of the first embodiment. On the other hand, like the first embodiment, the testing TFTs 35 are used to sense the potentials of the scanning lines 3 which vary depending on the kinds of defects occurring mainly within the display circuit 6, e.g. disconnection or short-circuit of the scanning line 3 or incomplete gate insulation of the TFT 5.

As compared to the first and second embodiments, in the third embodiment the scanning line driver 8 and display circuit 6 can be tested substantially independently and the location of the defect can be specified more easily.

An LCD device according to a fourth embodiment of the invention will now be described.

Figure 6:
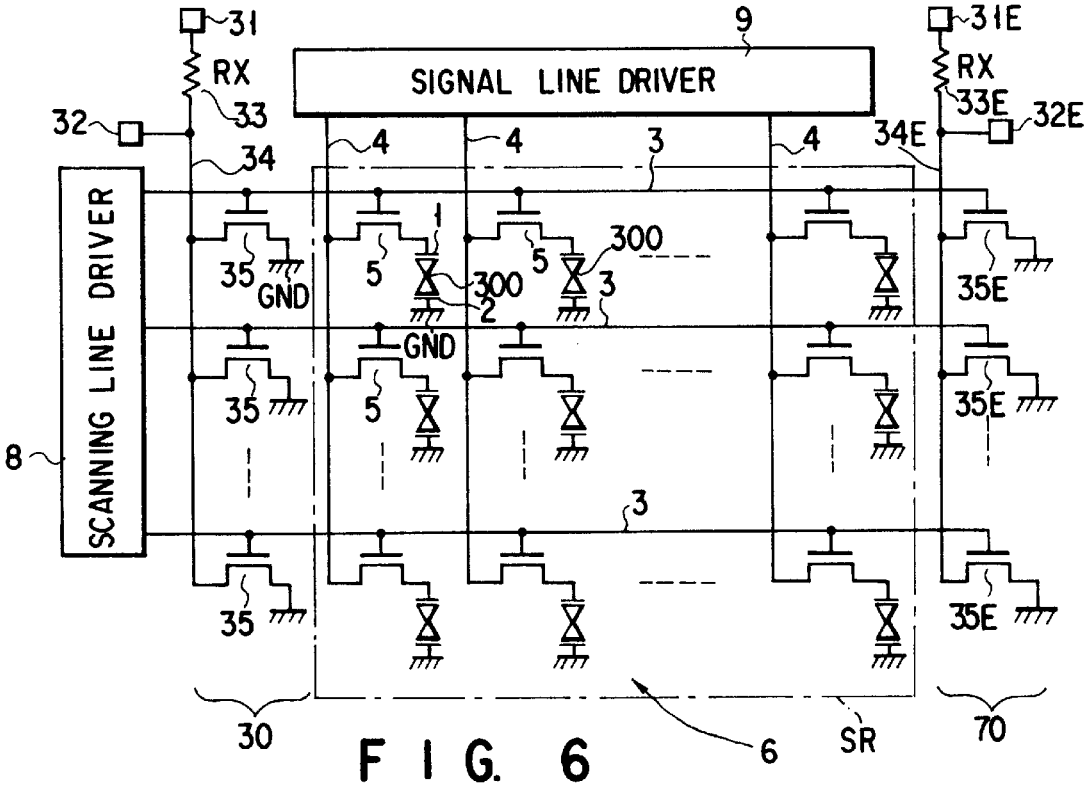
FIG. 6 shows a circuit formed on an array substrate of an LCD device according to a fourth embodiment of the invention.

FIG. 6 shows a circuit formed on an array substrate of the LCD device. The LCD device of the fourth embodiment is similar to the device of the first embodiment described with reference to FIGS. 1 to 3. In FIG. 6, similar components are denoted by the same reference numerals as those shown in FIGS. 1 to 3, and, therefore, repetitive explanations thereof are omitted.

In the array substrate of this LCD device, a scanning line test section 70 is further provided to more exactly detect a defect occurring mainly within the display circuit 6, e.g. disconnection or short-circuit of the scanning line 3 or incomplete gate insulation of the TFT 5. The scanning line test section 70 is located outside the display area SR on the side opposite to the scanning line test section 30. In this embodiment, for the purpose of easier understanding of a defect inspection with a use of the scanning line test sections 30 and 70, the signal line test section 50 shown in FIG. 3 is not provided.

The scanning line test section 30 includes a test potential pad 31, a monitor pad 32, a resistive element 33 connected between the pads 31 and 32, a test wiring line 34 disposed in parallel to the signal lines 4 and connected to the monitor pad 32, and an n-number of testing thin film transistors (testing TFTs) 35 each having a source-drain path connected between the test wiring line 34 and ground pad GND and having a gate connected to that portion of the corresponding scanning line 3, which is located between the scanning line driver 8 and the display area SR. At the time of the defect inspection, a test voltage Vh is applied between the test potential pad 31 and ground pad GND. (The test voltage Vh is determined according to the threshold voltages of the testing TFTs 35 such that each of the testing TFTs 35 is turned on upon supply of the scanning signal.)

The scanning line test section 70 includes a test potential pad 31E, a monitor pad 32E, a resistive element 33E connected between the pads 31E and 32E, a test wiring line 34E disposed in parallel to the signal lines 4 and connected to the monitor pad 32E, and an n-number of testing thin film transistors (testing TFTs) 35E each having a source-drain path connected between the test wiring line 34E and ground pad GND and having a gate connected to an end portion of the corresponding scanning line 3, which is remote from the corresponding testing TFT 35. At the time of the defect inspection, a test voltage Vh is applied between the test potential pad 31E and ground pad GND. (The test voltage Vh is determined according to the threshold voltages of the testing TFTs 35E such that each of the testing TFTs 35E is turned on upon supply of the scanning signal.)

In this embodiment, two of the testing TFTs 35 and 35E are provided for each scanning line 3. In this case, the potentials of the monitor pads 32 and 32E are monitored to detect a defect such as a malfunction of the scanning line driver 8, short-circuit or disconnection of the scanning line 3 connected to the scanning line driver 8, or destruction of the TFT 5 connected to the scanning line 3. It can be confirmed by the test sequence of the first embodiment that the scanning line driver 8 operates normally and none of the scanning lines 3 is short-circuited to another one. The disconnection can be detected after the confirmation by measuring and comparing the potentials of the monitor pads 32 and 32E with respect to each scanning line 3. If the scanning line 3 is disconnected, the potential of the monitor pad 32 is set to the voltage level Von and the potential of the monitor pad 32E is set to the voltage level Voff, as mentioned in the description of the first embodiment. If the measured potential is neither at level Voff nor at level Von, it may be considered that incomplete gate insulation has occurred in any of the TFTs 5 connected to the scanning line 3. According to the fourth embodiment, it is possible to distinguish the disconnection of the scanning line 3 and destruction of the TFT 5 from the defects of the display circuit 6 mentioned above.

An LCD device according to a fifth embodiment of the invention will now be described.

Figure 7:
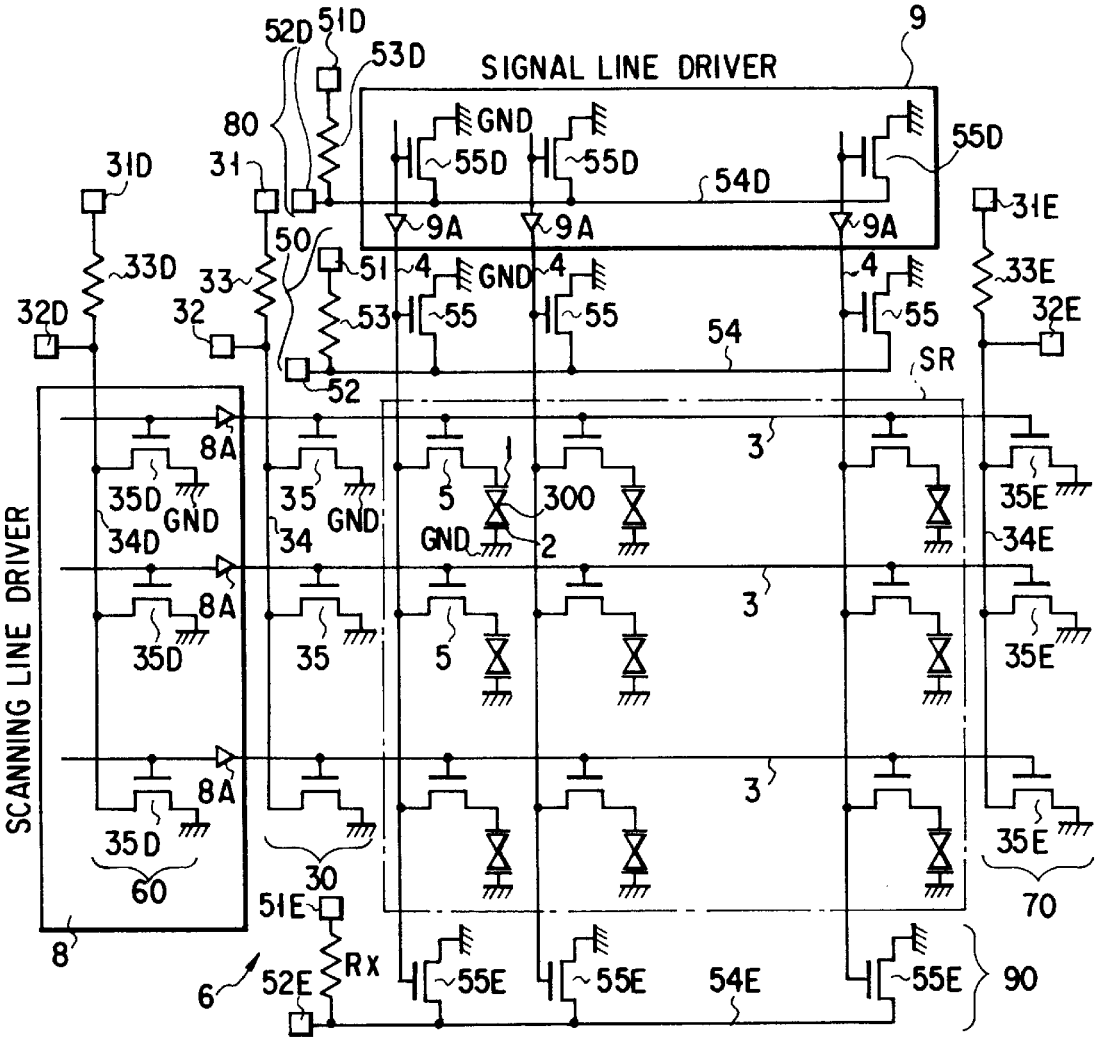
FIG. 7 shows a circuit formed on an array substrate of an LCD device according to a fifth embodiment of the invention.

FIG. 7 shows a circuit formed on an array substrate of the LCD device. The LCD device of the fifth embodiment is similar to the devices of the first to fourth embodiments described with reference to FIGS. 1 to 6. In FIG. 7, similar components are denoted by the same reference numerals as those shown in FIGS. 1 to 6, and therefore repetitive explanations thereof are omitted.

The array substrate of this LCD device includes all the outstanding features of the first to fourth embodiments, i.e. the scanning line test section 30, signal line test section 50, driver test section 60, and scanning line test section 70. Further, a driver test section 80 is provided in the scanning line driver 9 to exactly detect a malfunction of the signal line driver 9, and a signal line test section 90 is provided to exactly detect a defect occurring mainly within the display circuit 6, e.g. disconnection or short-circuit of the scanning line 4 or destruction of the TFT 5.

The scanning line test section 30 includes a test potential pad 31, a monitor pad 32, a resistive element 33 connected between the pads 31 and 32, a test wiring line 34 disposed in parallel to the signal lines 4 and connected to the monitor pad 32, and an n-number of testing thin film transistors (testing TFTs) 35 each having a source-drain path connected between the test wiring line 34 and ground pad GND and having a gate connected to that portion of the corresponding scanning line 3 which is located between the scanning line driver 8 and display area SR. At the time of the defect inspection, a test voltage Vh is applied between the test potential pad 31 and ground pad GND. (The test voltage Vh is determined according to the threshold voltages of the testing TFTs 35 such that each of the testing TFTs 35 is turned on upon supply of the scanning signal.)

The signal line test section 50 includes a test potential pad 51, a monitor pad 52, a resistive element 53 connected between the pads 51 and 52, a test wiring line 54 disposed in parallel to the scanning lines 3 and connected to the monitor pad 52, and an m-number of testing thin film transistors (testing TFTS) 55 each having a source-drain path connected between the test wiring line 54 and ground pad GND and having a gate connected to that portion of the corresponding signal line 4 which is located between the signal line driver 9 and display area SR. At the time of the defect inspection, a test voltage Vh is applied between the test potential pad 51 and ground pad GND. (The test voltage Vh is determined according to the threshold voltages of the testing TFTs 55 such that each of the testing TFTs 55 is turned on upon supply of the video signal of a specified level.)

The driver test section 60 includes a test potential pad 31D, a monitor pad 32D, a resistive element 33D connected between the pads 31D and 32D, a test wiring line 34D disposed in parallel to the signal lines 4 and connected to the monitor pad 32D, and an n-number of testing TFTs 35D each having a source-drain path connected between the test wiring line 34D and the ground pad GND and a gate connected to an input terminal of the corresponding output buffer 8A. At the time of the defect inspection, a test voltage Vh is applied between the test potential pad 31D and ground pad GND. (The test voltage Vh is determined according to the threshold voltages of the testing TFTs 35D such that each of the testing TFTs 35D is turned on upon supply of the scanning signal input to the corresponding output buffer 8A.) Specifically, the driver test section 60 has substantially the same structure as the scanning line test section 30, except that the testing TFTs 35D sense the potentials of the input terminals of the output buffers 8A.

The scanning line test section 70 includes a test potential pad 31E, a monitor pad 32E, a resistive element 33E connected between the pads 31E and 32E, a test wiring line 34E disposed in parallel to the signal lines 4 and connected to the monitor pad 32E, and an n-number of testing thin film transistors (testing TFTs) 35E each having a source-drain path connected between the test wiring line 34E and ground pad GND and having a gate connected to an end portion of the corresponding scanning line 3, which is remote from the corresponding testing TFT 35. At the time of the defect inspection, a test voltage Vh is applied between the test potential pad 31E and ground pad GND. (The test voltage Vh is determined according to the threshold voltages of the testing TFTs 35E such that each of the testing TFTs 35E is turned on upon supply of the scanning signal.)

The driver test section 80 includes a test potential pad 51D, a monitor pad 52D, a resistive element 53D connected between the pads 51D and 52D, a test wiring line 54D disposed in parallel to the scanning lines 3 and connected to the monitor pad 52D, and an m-number of testing TFTs 55D each having a source-drain path connected between the test wiring line 54D and the ground pad GND and a gate connected to an input terminal of the corresponding output buffer 9A. At the time of the defect inspection, a test voltage Vh is applied between the test potential pad 51D and ground pad GND. (The test voltage Vh is determined according to the threshold voltages of the testing TFTs 55D such that each of the testing TFTs 55D is turned on upon supply of the video signal of a specified level input to the corresponding output buffer 9A.) Specifically, the driver test section 80 has substantially the same structure as the signal line test section 50, except that the testing TFTs 55D sense the potentials of the input terminals of the output buffers 9A.

The signal line test section 90 includes a test potential pad 51E, a monitor pad 52E, a resistive element 53E connected between the pads 51E and 52E, a test wiring line 54E disposed in parallel to the scanning lines 3 and connected to the monitor pad 52E, and an m-number of testing thin film transistors (testing TFTS) 55E each having a source-drain path connected between the test wiring line 54E and ground pad GND and having a gate connected to an end portion of the corresponding signal line 4, which is remote from the corresponding testing TFT 55. At the time of the defect inspection, a test voltage Vh is applied between the test potential pad 51E and ground pad GND. (The test voltage Vh is determined according to the threshold voltages of the testing TFTs 55E such that each of the testing TFTs 55E is turned on upon supply of the video signal of a specified level.)

In the fifth embodiment, the n-number of scanning lines 3 (Y1–Yn) selectively driven by the scanning line driver 8 are electrically separated from the testing TFTs 35D by the output buffers 8A of the scanning line driver 8. The potential of each scanning line 3 varies, in the same manner as in the second embodiment, due to a defect occurring in the TFTs 5 connected to this scanning line 3. As has been described in connection the second embodiment, for example, when the resistance between the gate and source of the TFT 5 has considerably decreased due to the defective gate insulating film, the potential of the scanning line 3 falls from the level of the scanning signal supplied to the scanning line 3. Therefore, if the potential of the scanning line 3 is sensed by the testing TFT 35 in order to test the scanning line driver 8, there is a possibility that the scanning line driver 8 is determined to be defective despite the fact that the scanning signal is supplied to the scanning line 3. Thus, the scanning line driver 8 is tested with a use of the testing TFTs 35D for sensing the potentials of the input terminals of the output buffers 8A, which are electrically separated from the scanning lines 3. Specifically, the potentials of the input terminals of the output buffers 8A are not influenced by a defect occurring mainly within the display circuit 6, e.g. disconnection or short-circuit of the scanning line 3 or incomplete gate insulation of the TFT 5. Accordingly, the malfunction of the scanning line driver 8 can be exactly distinguished from the defect of the display circuit 6 in the same test sequence as that of the first embodiment.

In addition, the m-number of signal lines 4 (X1–Xm) selectively driven by the signal line driver 9 are electrically separated from the testing TFTs 55D by the output buffers 9A of the signal line driver 9. The potential of each signal line 4 varies due to a defect occurring in the TFTs 5 connected to this signal line 4. For example, when the resistance between the gate and source of the TFT 5 has considerably decreased due to the defective gate insulating film, the potential of the signal line 4 falls from the level of the video signal supplied to the signal line 4. If the potential of the signal line 4 is sensed by the testing TFT 55 in order to test the signal line driver 9, there is a possibility that the signal line driver 9 is determined to be defective despite the fact that the video signal is supplied to the signal line 4. Thus, the signal line driver 9 is tested with a use of the testing TFTs 55D for sensing the potentials of the input terminals of the output buffers 9A, which are electrically separated from the signal lines 4. Specifically, the potentials of the input terminals of the output buffers 9A are not influenced by a defect occurring mainly within the display circuit 6, e.g. disconnection or short-circuit of the signal line 4 or incomplete gate insulation of the TFT 5. Accordingly, the malfunction of the signal line driver 9 can be exactly distinguished from the defect of the display circuit 6 in the same test sequence as that of the first embodiment.

In the fifth embodiment, like the fourth embodiment, two of the testing TFTs 35 and 35E are provided for each scanning line 3. In this case, the potentials of the monitor pads 32 and 32E are monitored to detect a defect such as a malfunction of the scanning line driver 8, short-circuit or disconnection of the scanning line 3 connected to the scanning line driver 8, or destruction of the TFT 5 connected to the scanning line 3. It can be confirmed by the test sequence of the first embodiment that the scanning line driver 8 operates normally and none of the scanning lines 3 is short-circuited to another one. The disconnection can be detected after the confirmation by measuring and comparing the potentials of the monitor pads 32 and 32E with respect to each scanning line 3. If the scanning line 3 is disconnected, the potential of the monitor pad 32 is set to the voltage level Von and the potential of the monitor pad 32E is set to the voltage level Voff, as mentioned in the description of the first embodiment. If the measured potential is neither at level Voff nor at level Von, it may be considered that incomplete gate insulation has occurred in any of the TFTs 5 connected to the scanning line 3.

Furthermore, two of the testing TFTs 55 and 55E are provided for each signal line 4. In this case, the potentials of the monitor pads 52 and 52E are monitored to detect a defect such as a malfunction of the signal line driver 9, short-circuit or disconnection of the signal line 4 connected to the signal line driver 9, or destruction of the TFT 5 connected to the signal line 4. It can be confirmed by the test sequence of the first embodiment that the signal line driver 9 operates normally and none of the signal lines 4 is short-circuited to another one. The disconnection can be detected after the confirmation by measuring and comparing the potentials of the monitor pads 52 and 52E with respect to each signal line 4. If the signal line 4 is disconnected, the potential of the monitor pad 52 is set to the voltage level Von and the potential of the monitor pad 52E is set to the voltage level Voff, as mentioned in the description of the first embodiment. If the measured potential is neither at level Voff nor at level Von, it may be considered that destruction has occurred in any of the TFTs 5 connected to the signal line 4.

According to the fifth embodiment, it is possible to distinguish the disconnection of the scanning line 3, the disconnection of the signal line 4, and the incomplete gate insulation of the TFT 5 from the defects of the display circuit 6 mentioned above.

Figure 8A:
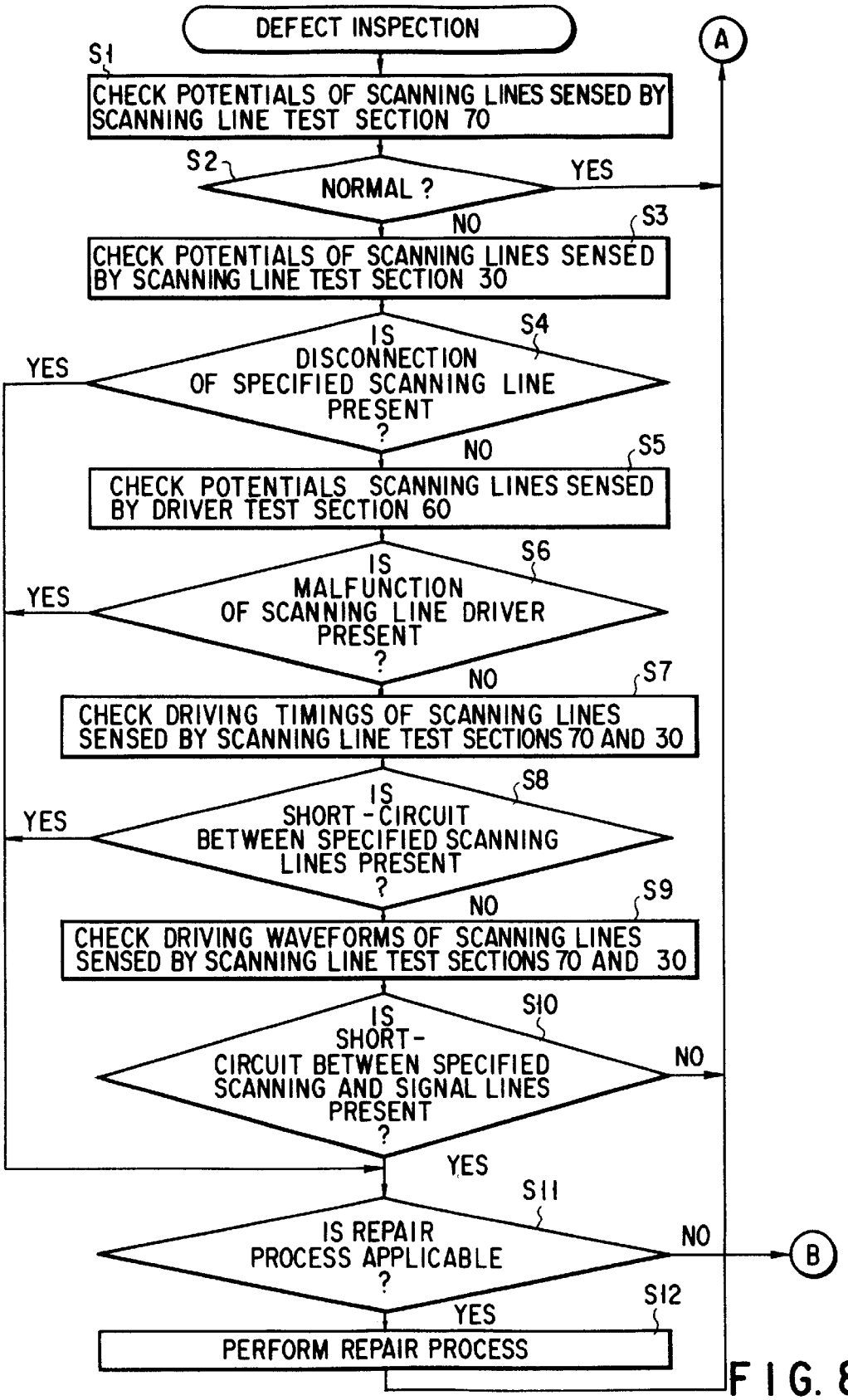
FIGS. 8A and 8B show flowcharts for explaining a defect inspection of the array substrate shown in FIG. 7.
Figure 8B:
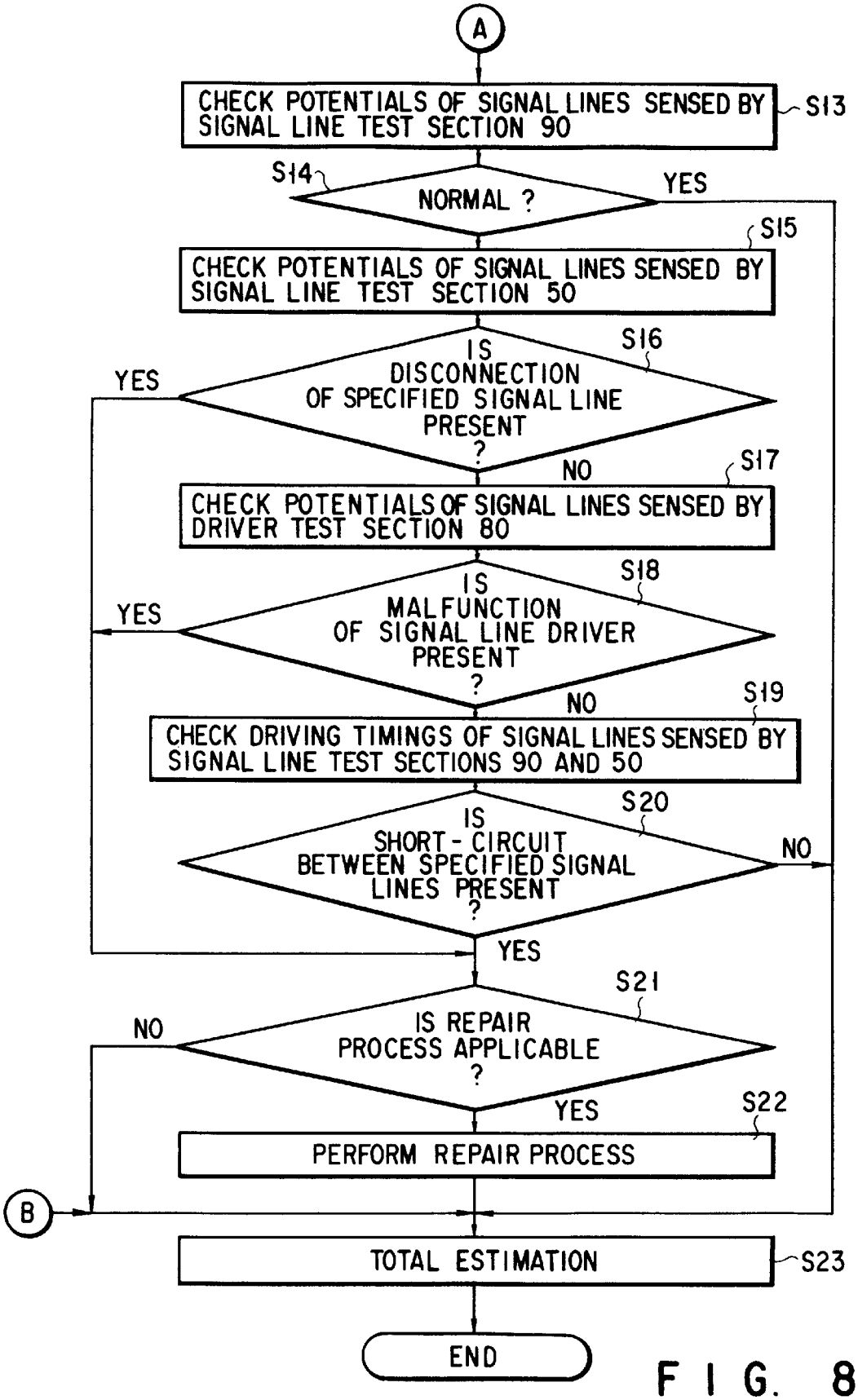

The defect inspection of the array substrate of the fifth embodiment is carried out as shown in FIGS. 8A and 8B, for example. Steps S1 to S12 are executed to cope with defects related to the scanning lines 3. Therefore, the scanning line driver 8 is initially driven in a condition where all the signal lines 4 are set into an electrically floating state. In step S1, the potentials of the scanning lines 3 sensed by the scanning line test section 70 are checked. When any of the potentials is detected to be abnormal in step S2, the potentials of the scanning lines 3 sensed by the scanning line test section 30 are checked in step S3. In step S4, it is determined from the checking result whether a disconnection of a specified scanning line 3 is present. When no disconnection is determined, the potentials of the scanning lines 3 sensed by the driver test section 60 are checked in step S5. In step S6, it is determined from the checking result whether a malfunction of the scanning line driver 8 is present. When no malfunction is determined, the driving timings of the scanning lines 3 sensed by the scanning line test sections 70 and 30 are checked in step S7. In step S8, it is determined from the checking result whether a short-circuit between specified scanning lines 3 is present. When no short-circuit is determined, the scanning driver 8 is driven in a condition where all the signal lines 4 are set to a present potential, and driving waveforms of the scanning lines 3 sensed by the scanning line test sections 70 and 30 are checked in step S9. In step S10, it is determined from the checking result whether a short-circuit between specified scanning and signal lines 3 and 4 is present.

When a disconnection of a specified scanning line 3 is determined in step S4, when a malfunction of the scanning line driver 8 is determined in step S6, when a short-circuit between specified scanning lines 3 is determined in step S8, and when a short-circuit between specified scanning and signal lines 3 and 4 is determined in step S10, it is determined by actual observation whether a repair process is applicable thereto, in step S11. When a repair process is detected to be applicable, the repair process is performed in step S12.

When the potentials are detected to be normal in step S2, when no short-circuit between specified scanning and signal lines 3 and 4 is determined in step S10, and when the repair process has been executed in step S12, step S13 is executed Steps S13 to S22 are executed to cope with defects related to the signal lines 4. Therefore, the signal line driver 9 is driven in a condition where all the scanning lines 3 are set into an electrically floating state. In step S13, the potentials of the signal lines 4 sensed by the signal line test section 90 are checked. When any of the potentials is detected to be abnormal in step S14, the potentials of the signal lines 4 sensed by the signal line test section 50 are checked in step S15. In step S16, it is determined from the checking result whether a disconnection of a specified signal line 4 is present. When no disconnection is determined, the potentials of the signal lines 4 sensed by the driver test section 80 are checked in step S17. In step S18, it is determined from the checking result whether a malfunction of the signal line driver 9 is present. When no malfunction is determined, the driving timings of the signal lines 4 sensed by the signal line test sections 90 and 50 are checked in step S19. In step S20, it is determined from the checking result whether a short-circuit between specified signal lines 4 is present.

When a disconnection of a specified signal line 4 is determined in step S16, when a malfunction of the signal line driver 9 is determined in step S18, and when a short-circuit between specified signal lines 4 is determined in step S20, it is determined by actual observation whether a repair process is applicable thereto, in step S21. When a repair process is detected to be applicable, the repair process is performed in step S22.

Total estimation is performed in step S23 when the repair process is determined to be not applicable in step S11 or S21, when the potentials are detected to be normal in step S14, when no short-circuit between specified signal lines 4 is determined in step S20, and when the repair process has been executed in step S22. In this estimation, the array substrate which no defect is detected or which is repaired with respect to detected defects is regarded as a defectless product. The defective testing thin film transistor is repaired by isolating the transistor from a corresponding pixel electrode wiring line. Further, if it is determined that the array substrate has a defect which cannot be repaired, this substrate is discarded.

In addition, when the defect inspection is performed with respect to the signal line, the output voltage from the signal line driver 9 is set to a level enough to drive the testing thin film transistor.

The defect inspection can be performed in a different sequence. For example, the sequence can be started from a step of detecting defects present on the signal lines. Further, the repair process can be executed after the total estimation. However, the repair process should be executed during the manufacture of the array substrate in order to improve the reliability thereof. As for the defective array substrate which cannot easily be repaired, it can be discarded without executing the repair process after taking the yield and manufacturing cost into consideration.

An additional description will be given of the outstanding features of the first to fifth embodiments. In the array substrate 100, the gates of, for example, an n-number of testing thin film transistors (TFTs) 35 are respectively connected to one set of pixel wiring lines such as n-number of scanning lines 3, and a test wiring section including the test potential pad 31, monitor pad 32, resistive element 33, test wiring line 34 and ground pad GND is connected to the source-drain paths of the testing TFTs 35 in order to detect the operation states corresponding to the gate potentials. At the time of the defect inspection of the array substrate 100, a voltage of, e. g. a scanning signal is applied via each scanning line 3 to the TFTs 5 serving as switching elements via one scanning line 3. If a defect such as disconnection, short-circuit or element destruction is present in one scanning line 3 or the TFTs 5 serving as the switching elements connected to the scanning line 3, the potential of the scanning line 3 varies depending on the kind of defect. Therefore, the testing TFT 35 serves to sense the potential of the scanning line 3. Specifically, the testing TFT 35 is controlled by the potential of the scanning line 3 to have a conductivity of resistance reflecting the kind of defect. Thus, information about the aforementioned defect can be obtained by supplying a current to the testing TFTs 35 through the test wiring section and measuring a voltage drop across the testing TFTs 35. Further, it is possible to specify where the defect is located by sequentially obtaining the defect information with respect to all the scanning lines 3.

The test wiring section is electrically insulated from each scanning line 3 by means of the gate insulating film of a corresponding testing TFT 35. This structure solves the prior art problem that one scanning line 3 connected to the gate of a testing TFT 35 is short-circuited to another scanning line 3 when the gate electrode and source-drain path of the testing TFT 35 are electrically in contact with each other due to a defect in, e.g., the gate insulating film formed therebetween. The n-number of the testing TFTs 35 have source-drain paths which are connected in parallel by using a test wiring line 34. Therefore, the wiring structure of the array substrate is prevented from being complicated to attain a reliable defect inspection. In addition, since the switching elements are thin film transistors 5, these transistors 5 can be formed along with the testing TFTs 35 through the common manufacturing process. Therefore, an individual process is not required for forming the testing TFTs 35.

According to the present invention, defects in the pixel wiring lines or switching elements can be exactly detected without greatly changing the circuit components or requiring complicated wiring structure. Since the defects can be detected substantially independently for the respective pixel wiring lines or switching elements, the locations of the defects can easily be specified. As for a defective testing TFT included in the test supporting circuit, it can be removed to prevent yield of array substrates from being decreased.

A defect inspection can be performed by using the test supporting circuit after the array substrate has been produced or main circuit components of the array substrate have been formed. The defect inspection can be performed irrespective of the step of producing the counter-substrate and the step of combining the array substrate and counter-substrate with the liquid crystal layer interposed. As a matter of course, the defect inspection does not need to be performed after manufacture of the liquid crystal display device is completed. Therefore, the defectless counter-substrate or liquid crystal layer can be prevented from being discarded due to the defect in the array substrate. This enhances the yield of liquid crystal display devices.

The earlier detection of a defect in the electric circuit in the manufacturing process of the liquid crystal display device contributes not only to enhancing the yield and reducing the manufacturing cost, but also to maintaining the reliability of the liquid crystal display device.

The present invention is not limited to the first to fifth embodiments, and can be variously modified without departing from the spirit of the invention.

In the LCD device of each embodiment, the scanning line driver 8, as well as signal line driver 9, is provided on one side of the display area SR on the array substrate. However, this invention is applicable to an array substrate structure wherein first and second scanning line drivers are provided on both sides of the display area SR in the direction of scanning lines 3, thereby to drive odd-numbered scanning lines 3 and even-numbered scanning lines 3 independently. This invention is also applicable to an array substrate structure wherein first and second signal line drivers are provided on both sides of the display area SR in the direction of signal lines 4, thereby to drive odd-numbered signal lines 4 and even-numbered signal lines 4 independently. In these cases, the testing TFTs are arranged symmetrical in accordance with the first and second scanning line drivers or first and second signal line drivers.

The arrangement of the testing TFTs on the array substrate 100 of each embodiment may be changed to facilitate the defect inspection or to improve the relationship with the arrangement of the other components. For example, the testing TFTs 35 and 55 shown in FIG. 3 do not need to be positioned between the scanning line driver 8 and display area SR and between the signal line driver 9 and display area SR, respectively. If part of the display area SR remains unused, the testing TFTs may be formed in this part of the display area SR. If the scanning lines 3 and signal lines 4 are formed to extend across the scanning line driver 8 and signal line driver 9, the testing transistors 35D and 55D, whose gates are respectively connected to the scanning lines 3 and signal lines 4, may be arranged outside the scanning line driver 8 and signal line driver 9.

In each embodiment, the ground pad GND is set at a reference potential of 0 V and is connected to the source-drain paths of the testing TFTs 35, 35D, 35E, 55, 55D and 55E. The reference voltage is not limited to 0 V and is variable in a range in which the testing TFTs can be rendered conductive, in relation to the potentials of the test potential pads 32, 32D, 32E, 52, 52D and 52E. Accordingly, at the time of the defect inspection, a test voltage of a specific waveforms may be applied between the monitor pads 32, 32D, 32E, 52, 52D and 52E and the ground pad GND.

The resistive elements 33, 33D, 33E, 55, 55D and 55E may be formed of TFTs each having a ON resistance or OFF resistance serving as the resistance Rx. These resistive elements may be provided outside the LCD device to reduce the number of pads.

As a result of the defect inspection, a defect of incomplete gate insulation would be detected in the testing TFT 35, 35D, 35E, 55, 55D or 55E formed on the array substrate 100. However, the array substrate 100 can be repaired to eliminate the influence of the defect by setting the source-drain path of the defective testing TFT into an electrically floating state or by trimming the gate of the defective testing TFT from the corresponding scanning line 3 or signal line 4 by means of a laser trimming device. The repaired array substrate 100 may be used to manufacture an LCD device which will perform a normal display operation.

Figure 9:
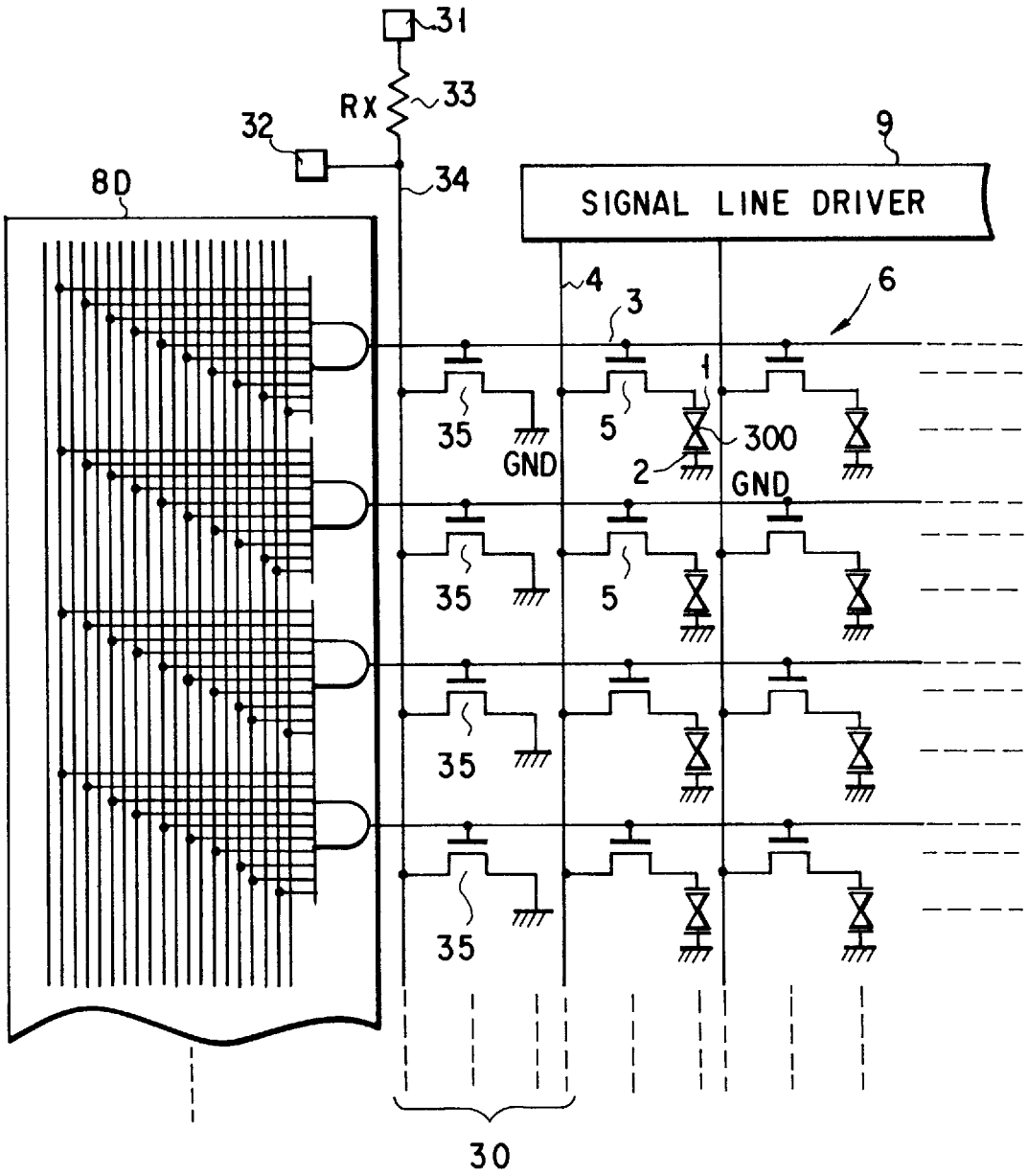
FIG. 9 shows an example in which the present invention is applied to a decoder-type scanning line driver.

The present invention is applicable to a decoder-type scanning line driver 8D shown in FIG. 9. The scanning line driver 8D decodes a numerical signal coming from a liquid crystal controller and updated in a binary order, thereby sequentially selecting and driving an n-number of scanning lines. In particular, since the numerical signal directly designates a scanning line to be driven for the defect inspection, the scanning line can be more easily selected than in the case using a shift register which repeats a shift operation to designate the scanning line.

Figure 10:
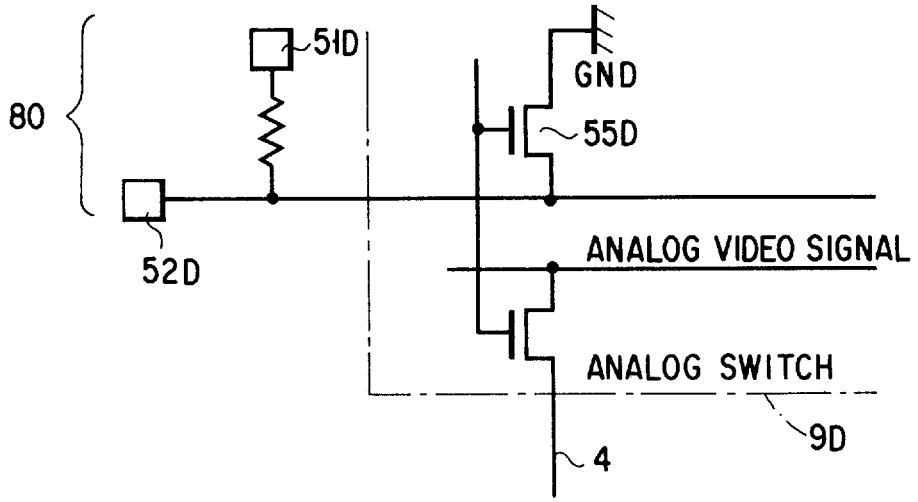
FIG. 10 shows an example in which the present invention is applied to an analog switch-type signal line driver.

The present invention is applicable to an analog switch-type signal line driver 9D shown in FIG. 10. In this case, the testing thin film transistor 55D is connected to an analog switch as shown in FIG. 10.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An array substrate for a liquid crystal display device, comprising:

an insulating substrate;

a plurality of pixel electrodes arrayed in a matrix having rows and columns on the insulating substrate;

a set of first pixel wiring lines formed along rows of said pixel electrodes on the insulating substrate;

a set of second pixel wiring lines formed along columns of said pixel electrodes on the insulating substrate;

a plurality of switching elements, formed on the insulating substrate at positions adjacent to intersections of the first and second pixel wiring lines, each for supplying a video signal from a corresponding one of the second pixel wiring lines to a corresponding one of the pixel electrodes in response to a scanning signal from a corresponding one of the first pixel wiring lines; and a test supporting circuit for sensing potentials of at least one set of said first and second pixel wiring lines, wherein said test supporting circuit includes a first test section having a plurality of testing thin film transistors whose gates are respectively connected to the pixel wiring lines of one set, and a test wiring section connected to source-drain paths of the testing thin film transistors and used when detecting operation states of the testing thin film transistors corresponding to the gate potentials thereof; and said test wiring section includes first and second potential pads for receiving a test voltage applied thereto, a resistive element connected in series with a parallel circuit of the source-drain paths of the testing thin film transistors between said first and second potential pads to divide the test voltage according to a resistance ratio between the resistive element and the testing thin film transistors, and a monitor pad connected to a node between said resistive element and the source-drain path of each testing thin film transistor.

2. The array substrate according to claim 1, wherein said test wiring section further includes a test wiring line connecting said monitor pad commonly to the source-drain paths of said testing thin film transistors.

3. The array substrate according to claim 1, wherein said array substrate further includes a first driver for supplying a scanning signal to the first pixel wiring lines and a second driver for supplying a video signal to the second pixel wiring lines.

4. The array substrate according to claim 3, wherein the gates of the testing thin film transistors of said first test section are connected respectively to the first pixel wiring lines.

5. The array substrate according to claim 3, wherein the gates of the testing thin film transistors of said first test section are connected respectively to the second pixel wiring lines.

6. A liquid crystal display device comprising an array substrate, a counter-substrate, and a liquid crystal layer held between said array substrate and said counter-substrate, said array substrate including:

an insulating substrate;

a plurality of pixel electrodes arrayed in a matrix form on the insulating substrate;

a set of first pixel wiring lines formed along rows of said pixel electrodes on the insulating substrate, a set of second pixel wiring lines formed along columns of said pixel electrodes on the insulating substrate, a plurality of switching elements, formed on the insulating substrate at positions adjacent to the intersections of the first and second pixel wiring lines, each for supplying a video signal from a corresponding one of the second pixel wiring lines to a corresponding one of the pixel electrodes in response to a scanning signal from a corresponding one of the first pixel wiring lines;

a first driver for supplying the scanning signal to the first pixel wiring lines;

a second driver for supplying the video signal to the second pixel wiring lines; and a test supporting circuit for sensing potentials of the first and second pixel wiring lines;

said counter-substrate including:

an insulating substrate; and a counter-electrode formed on said insulating substrate thereof;

wherein said test supporting circuit includes a first test section having a plurality of testing thin film transistors whose gates are respectively connected to the first pixel wiring lines, and a test wiring section connected to source-drain paths of the testing thin film transistors of the first test section and used when detecting operation states of the testing thin film transistors corresponding to the gate potentials thereof; and a second test section having a plurality of testing thin film transistors whose gates are respectively connected to the second pixel wiring lines, and a test wiring section connected to source-drain paths of the testing thin film transistors of the second test section and used when detecting operation states of the testing thin film transistors corresponding to the gate potentials thereof; and said test wiring section of each test section includes first and second potential pads for receiving a test voltage applied thereto, a resistive element connected in series with a parallel circuit of the source-drain paths of the testing thin film transistors between said first and second potential pads to divide the test voltage according to a resistance ratio between the resistive element and the testing thin film transistors, and a monitor pad connected to a node between said resistive element and the source-drain path of each testing thin film-transistor.

* * * * *